United States Patent [19]

Pawlowski

[11] 4,422,551

[45] Dec. 27, 1983

[54] BLISTER PACKAGE DISPENSER

[75] Inventor: Thomas D. Pawlowski, Neenah, Wis.

[73] Assignee: James River-Dixie/Northern, Inc., Norwalk, Conn.

[21] Appl. No.: 326,756

[22] Filed: Dec. 2, 1981

[51] Int. Cl.[3] ..... B65D 75/00

[52] U.S. Cl. ..... 206/461; 206/462; 206/471; 206/475

[58] Field of Search ..... 206/461, 471, 472, 475, 206/474, 473, 470, 462, 532

[56] References Cited

U.S. PATENT DOCUMENTS

| | | | |
|---|---|---|---|
| D. 138,698 | 9/1944 | Salfisberg | 206/472 |
| 2,962,161 | 11/1960 | Lacy | 206/486 |
| 3,282,413 | 11/1966 | Sparks | 206/462 |
| 3,397,671 | 8/1968 | Hartman, Jr. et al. | 206/532 |
| 4,125,190 | 11/1978 | Davie, Jr. et al. | 206/532 |

*Primary Examiner*—William T. Dixson, Jr.
*Assistant Examiner*—Brenda J. Ehrhardt
*Attorney, Agent, or Firm*—Finnegan, Henderson, Farabow, Garrett & Dunner

[57] ABSTRACT

A folder for containing a strip of blister package units for pharmaceutical capsules includes a generally flattened sleeve of paperboard having side wall panels and a planar panel folded inwardly from an edge of the sleeve material. The panel is generally coplanar with one side wall panel of the sleeve, and includes a window, wherein a strip of severable blister package units may be inserted within the sleeve so that the blister portion of at least one of the units projects through the window, whereby the strip is retained within the sleeve.

10 Claims, 5 Drawing Figures

FIG.1
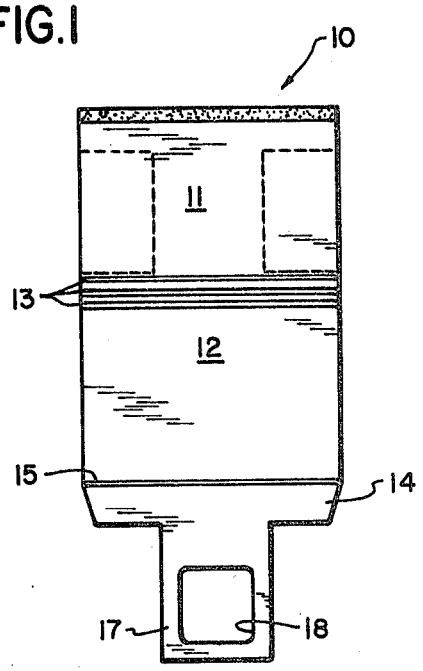
FIG.2
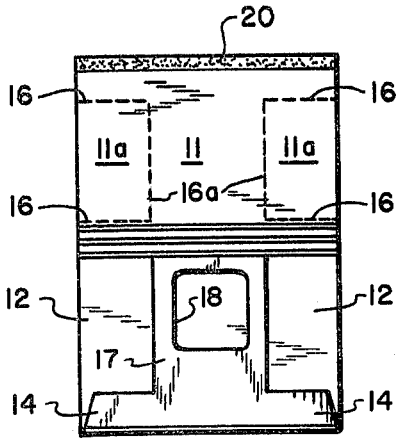
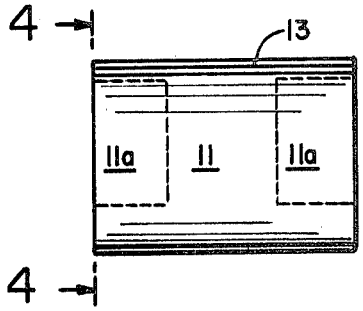
FIG.3
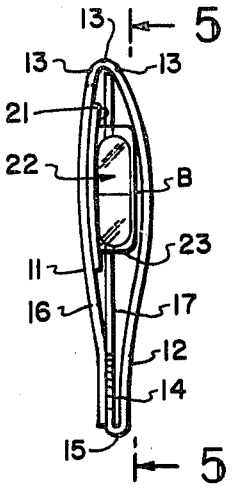
FIG.4
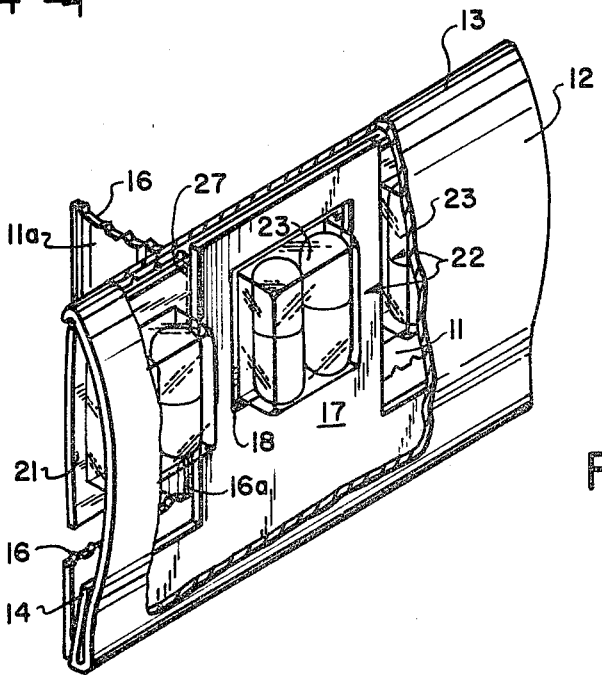
FIG.5

BLISTER PACKAGE DISPENSER

BACKGROUND OF THE INVENTION

This invention relates to packaging, and especially to the packaging of pharmaceutical capsules.

Capsules conveniently are dispensed in blister package format wherein uniform blister package units are arranged in strips having transverse lines of weakness that permit a unit to be torn from the strip by the user, and a predetermined number of capsules are usually sold in a package of this type. The strips are relatively flexible, and it is desirable to provide a package for containing them that protects the strip and is convenient for the user.

It is a general objective of this invention to provide an improved package for containing a strip of blister-packaged capsules and facilitating dispensation thereof in predetermined units.

SUMMARY OF THE INVENTION

In achievement of the foregoing general objective, the invention contemplates an improved package structure comprising a generally flattened sleeve of flexible and resilient material having a planar panel of like material retained along an edge thereof within said sleeve, in substantially coplanar relation with a wall portion of the flattened sleeve, said panel including a window portion, wherein a strip of severable blister package units is insertable within said sleeve so that the blister portion of at least one of said units projects through said window, whereby the strip is releasably retained within said sleeve.

The manner in which the foregoing as well as other objectives of the invention may best be achieved will be more fully understood from a consideration of the following description, taken in light of the accompanying drawing.

BRIEF DESCRIPTION OF THE DRAWING

FIG. 1 is a top plan view of a blank of flexible and resilient material from which the sleeve and inner panel of the invention are set up;

FIGS. 2 and 3 are sequential showings of the mode of setting up the sleeve;

FIG. 4 is a side elevational view of the sleeve, looking in the direction of arrows 4—4 in FIG. 3, illustrating the manner in which the strip package is inserted for retention by the sleeve; and FIG. 5 is a fragmented perspective view of the completed package, looking in the direction of arrows 5—5 in FIG. 4, including the set-up sleeve and its inner panel, and a strip of blister packaged capsules.

DESCRIPTION OF THE PREFERRED EMBODIMENT

With more detailed reference to the drawing, there is seen in FIG. 1 a blank 10 of a suitable flexible and resilient material, such as paperboard, including side panels 11, 12, respectively, hingedly connected along parallel score lines 13. Side panel 12 includes a flap 14 hingedly connected along a score line 15 parallel to score lines 13. Flap 14 includes a panel 17 extending from its free edge and provided with a generally rectangular window 18, the purpose of which will be more fully described in what follows.

With reference to FIG. 2, to set up the blank 10 into a sleeve (FIGS. 3 to 5), flap 14 is folded tightly about score line 15 onto side panel 12, so that panel 17 closely overlies panel 12. With reference to FIG. 2, side panel 11 is then folded loosely about score lines 13 and glued to flap 14 in glue area 20 (FIG. 2). Further to the set-up sleeve in FIG. 4, and as seen also in FIG. 5, panel 17 closely overlies side panel 11 to which flap 14 is glued, and side panel 12, due to the loose fold afforded by score lines 13, is spaced from the rear panel.

As is best seen in FIG. 5, and also in FIG. 4, a strip 21 of package units 22 generally comprises a series of equally spaced clear plastic blisters 23 having, as is conventional, peripheral planar flanges sandwiched between a layer of paper and a layer of foil adherent to one another. The strip 21 has lines of weakness, such as perforations 27 (FIG. 5), extending transversely thereof and evenly spaced between the flanges of blisters 23. The blisters 23 are of generally rectangular peripheral configuration, of a dimension slightly less than the dimension of window 18.

To load the sleeve, and with reference also to FIG. 4, a blade (not shown) is inserted between panel 17 and side panel 11 to urge panel 17 toward panel 12, to the region B. While panel 17 is held in this region, a strip 21 of three units 22 is slid into the sleeve with blisters 23 facing panels 12 and 17, until such time the center one of blisters 23 is aligned with window 18. The blade is then removed, whereupon panel 17, due to its flexible resilience, snaps back in place closely overlying strip 21 with blisters 23 projecting through window 18 and holding the strip against side panel 11, as is seen also in FIG. 5. This deposition of panel 17 and blisters 23 on strip 21 cooperates to hold the strip in place.

Facilitating removal of units 22 are panels **11*a* defined by perforations 16, 16*a* in side panel 11. To remove a unit 22, and with reference to FIG. 5, the user need only tear a panel 11*a* along perforations 16 and fold it outwardly about perforations 16*a*, then reach in and remove an end unit by tearing strip 21 along the perforations 27. When the end units 22 have been used, the remaining, retained center unit 22 can be removed by reaching in and deflecting panel 17 to release the unit, or the panel 11 may be released from flap 14**.

From the foregoing, it will be appreciated that the invention achieves an improved package, convenient to carry by a user, for containing a strip of blister packaged capsules and facilitating their dispensation in predetermined units.

While a preferred embodiment of the invention has been disclosed, it will be understood that it is susceptible of modifications, as is contemplated by the scope of the appended claims.

I claim:

1. An improved dispensing package structure for a strip of severable blister package units, comprising:

a generally flattened end-accessible sleeve of flexible and resilient material;

a planar panel of like flexible and resilient material retained along a first edge thereof within said sleeve and having a free edge opposite said first edge free to move within said sleeve, said planar panel being in substantially coplanar relation with a confronting inner surface portion of the flattened sleeve, said panel having a window portion, the strip of severable blister package units being inserted within said sleeve through an end thereof between said planar panel and said confronting inner surface portion by deflecting said planar panel away from said inner surface portion and inserting said strip until the blister portion of at least one of said units aligns to project through said window, whereby the resilient planar panel resumes its undeflected planar shape for releaseably retaining the strip within the sleeve by the interaction of said window and said aligned blister portion of said package units.

2. An improved dispensing structure for packaging a strip of severable blister package units, comprising:

a single, suitably cut and scored blank of flexible and resilient material, said blank including first and second side wall panels of substantially the same size folded over one another, and a planar panel folded between said side wall panels, a free edge portion of said first side wall panel being adherent to a portion of said planar panel in provision of a flattened end-accessible sleeve in conjunction with said second side wall panel;

said planar panel having a window portion for receiving a blister package unit and wherein the strip of severable blister package units may be inserted end-wise into said sleeve between said planar panel and said first wall by deflecting said planar panel away from said first wall and towards said second wall until said blister portion of said package units aligns to project through said window and whereby the resilient planar panel resumes its undeflected planar shape for releaseably retaining said strip within said sleeve by the interaction of said window and said aligned blister portion of said package units.

3. The structure of claim 1 or 2 wherein said material is paperboard.

4. The structure of claim 2, wherein there are provided in said first side wall panel a pair of mutually spaced lines of weakness extending between a free edge of said first side wall panel and the region thereof adjacent said second side wall panel, and means defining a fold line extending between said lines of weakness, whereby a portion of said first side wall panel may be torn along said lines of weakness and folded along said fold line, away from a retained strip for facilitating removal of a package unit.

5. The structure of claim 4, wherein said material is paperboard.

6. In a dispensing package structure, the combination of a generally flattened sleeve of flexible and resilient material open at both ends and having a planar panel of like material retained along an edge thereof within said sleeve, said planar panel being resiliently maintained in substantially coplanar relation with a confronting inner surface portion of the flattened sleeve, said planar panel including a window portion;

the resiliency of said planar panel releaseably retaining a strip of severable blister package units within said sleeve between said planar panel and said confronting inner surface portion, the blister portion of at least one of said units projecting through said window.

7. The structure of claim 6, wherein said sleeve and said planar panel are formed from a single, suitably cut and scored blank of the recited material, said blank including a pair of side wall panels of substantially the same size folded over one another, said planar panel being folded between said side wall panels, and a free edge portion of one of said side wall panels being adherent to a portion of said planar panel in provision of the recited flattened sleeve.

8. The structure of claim 6 or 7 wherein said material is paperboard.

9. The structure of claim 7, wherein there are provided in said one side wall panel a pair of mutually spaced lines of weakness extending between a free edge of said one side wall panel and the region thereof adjacent said planar panel, and means defining a fold line extending between said lines of weakness, whereby a portion of said one side wall panel may be torn along said lines of weakness and folded along said fold line, away from said retained strip to facilitate removal of a package unit.

10. The structure of claim 9, wherein said material is paperboard.

* * * * *